US005816130A

United States Patent [19]

Aukerman

[11] Patent Number: 5,816,130

[45] Date of Patent: Oct. 6, 1998

[54] RULE DIE AND ANCHOR THEREFOR

[76] Inventor: John F. Aukerman, 314 Hillcrest, Eaton, Ohio 45320

[21] Appl. No.: 762,295

[22] Filed: Dec. 9, 1996

[51] Int. Cl.[6] ..... B26D 1/62

[52] U.S. Cl. ..... 83/698.31; 83/348; 83/674

[58] Field of Search ..... 83/698.31, 698.41, 83/673, 674, 663, 495, 508, 830, 831, 698.11, 348

[56] References Cited

U.S. PATENT DOCUMENTS

| | | | |
|---|---|---|---|
| 1,766,244 | 6/1930 | Cumfer | 83/698.41 |
| 3,340,757 | 9/1967 | Rudszinat | 83/698.41 |
| 3,792,637 | 2/1974 | Saunders | 83/698.41 |
| 3,823,633 | 7/1974 | Ross | 83/698.41 |
| 4,400,117 | 8/1983 | Smith | 83/698.41 |
| 4,826,090 | 5/1989 | Orphall | 83/698.41 |
| 4,848,202 | 7/1989 | Crampton | 83/698.31 |
| 4,920,843 | 5/1990 | Stromberg et al. | 83/698.41 |
| 5,029,505 | 7/1991 | Holliday | 83/698.31 |
| 5,086,683 | 2/1992 | Steidinger | 83/698.31 |
| 5,224,408 | 7/1993 | Steidinger | 83/698.31 |
| 5,275,076 | 1/1994 | Greenwald | 83/698.31 |
| 5,282,409 | 2/1994 | Rojas | 83/698.31 |

FOREIGN PATENT DOCUMENTS 570020 12/1957 Italy .

*Primary Examiner*—Maurina T. Rachuba
*Attorney, Agent, or Firm*—Robert W. Graham

[57] ABSTRACT

A rule die and anchor therefor for use in forming a work piece, includes a support surface, a configuration forming member having a connecting surface connected to the support surface and having a configuration forming surface outwardly extending therefrom in a predetermined configuration such that when contacted with the work piece in a predetermined manner imparts a desired configuration on the work piece and wherein the configuration forming member includes an anchor surface, and an anchor member having a base connected to the support surface and an anchor lip extending from the base and contacting the anchor surface in a manner to anchor the configuration forming member to the support surface.

9 Claims, 2 Drawing Sheets

RULE DIE AND ANCHOR THEREFOR

BACKGROUND OF THE INVENTION

1. Field of the Invention

The present invention relates to rule dies for use in forming containers and the like. More particularly, this invention is directed to a rule die and anchor therefore to aid the use thereof.

2. Related Art

Presently, rule dies include a support surface having one or more geometrically configured predetermined channels or grooves therein having steel rule members press fit therein. The configuration used imparts a desired shape or cut on a work piece, e.g., cardboard material to form a box.

The rule die will often take the form of a cylinder in order to be used in an in-line manufacturing process. Accordingly, the steel rule must be bent to conform to the arcuateness of the cylinder. However, due to the memory of steel and other forces which are exerted on the rule die during the manufacturing process, the steel rule often works its way out of the desired position within the channel. This results in inconsistencies between the finished work pieces and in some cases down time for repair or replacement of the rule die.

There is therefore a need to improve rule dies and overcome the problems so stated. The present invention provides a solution to the problems.

BRIEF SUMMARY OF THE INVENTION

It is an object to improve rule dies.

It is another object to improve the manner in which steel rule is secured to a support plate in a steel rule die.

Accordingly, the present invention is directed to a rule die and anchor therefore for use in forming a work piece. The rule die includes a support surface, a configuration forming member having a connecting surface connected to the support surface and having a configuration forming surface outwardly extending therefrom in a predetermined configuration such that when contacted with the work piece in a predetermined manner imparts a desired configuration on the work piece and wherein the configuration forming member includes an anchor surface, and an anchor member having a base connected to the support surface and an anchor lip extending from the base and contacting the anchor surface in a manner to anchor the configuration forming member to the support surface.

The support surface is commonly arcuate and includes a recessed surface wherein the anchor member base is disposed below a remainder of the support surface. The anchor surface is preferably formed between the connecting surface and the configuration forming surface.

Other objects and advantages will be readily apparent to those skilled in the art upon viewing the drawings and reading the detailed description hereafter.

DETAILED DESCRIPTION OF THE INVENTION

Figure 1:
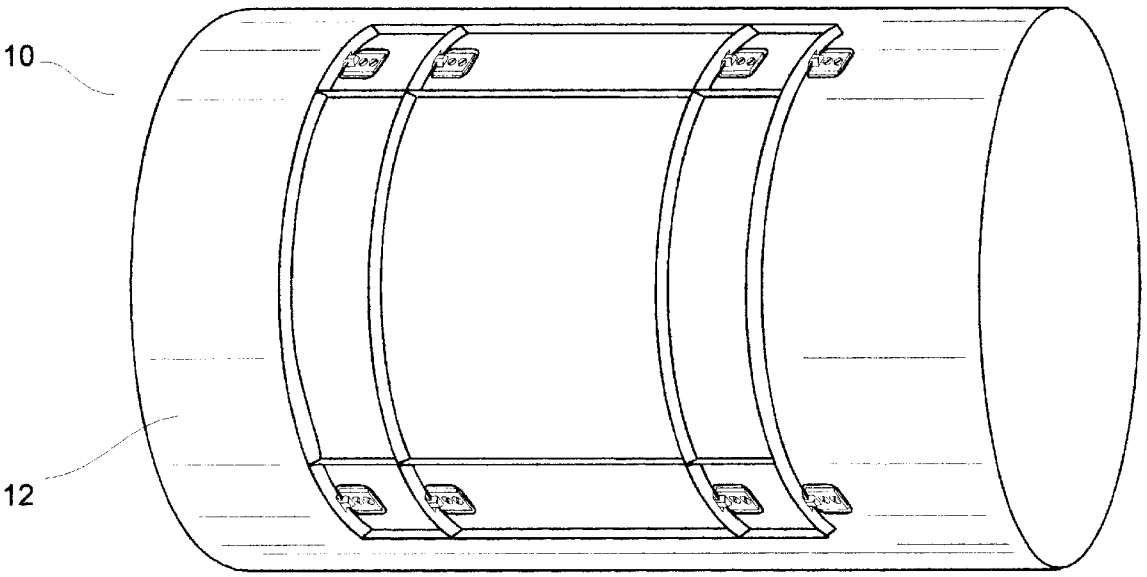
FIG. 1 is a perspective view of the present invention.
Figure 3:
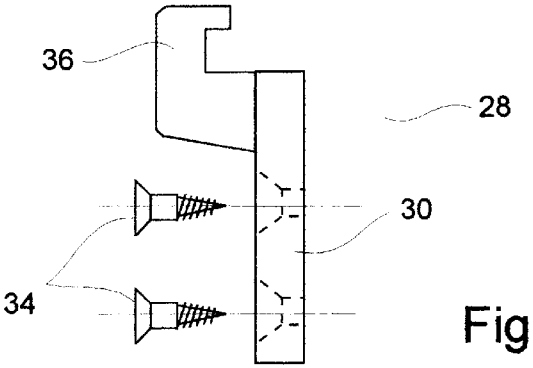
FIG. 3 is a side view of the anchor of the present invention.
Figure 4:
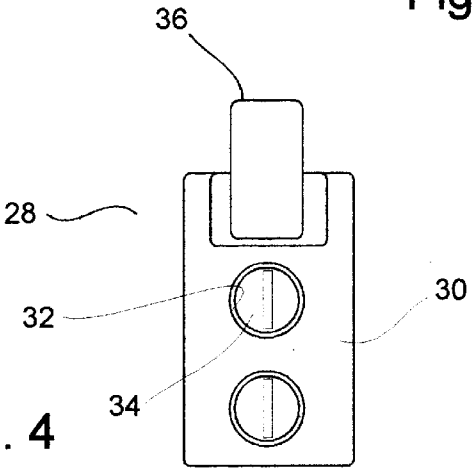
FIG. 4 is a top view of the anchor of the present invention.

Referring now to the drawings, a rule die of the present invention is generally designated by the numeral 10. The rule die includes a support surface 12 which is commonly made of a plywood material and formed in a generally cylindrical shape for an in-line process use. The support surface 12, includes a plurality of channeled or grooved surfaces 13 wherein the channeled surfaces 13 include surfaces channeled in an arcuate manner along the support surface 12, and a recessed surfaces 15. While the material and shape are so stated, it is understood that the material and shape will vary to meet the particular application.

The rule die 10 includes a plurality of configuration forming members 14 and 16 each having a connecting surface 18 and 20, respectively, connected to the grooved surfaces 13 of the support surface 12 in a press-fit manner. The configuration forming members 14 and 16 may be of a suitable material to carry out their function in the invention, commonly steel or like material. The configuration forming members 14 and having an arcuate configuration forming surface 22 outwardly extending therefrom in a predetermined configuration such that when contacted with the work piece in a predetermined manner imparts a desired configuration on the work piece in the form of a perimeter dimensional cut. The configuration forming members 16 and having a configuration forming surface 24 outwardly extending therefrom in a predetermined configuration such that when contacted with the work piece in a predetermined manner imparts a desired configuration on the work piece in the form of an inner dimensional crease or indentation which forms a line of a bend in the work piece.

Each of the configuration forming members 14 and 16 includes a plurality of anchor surfaces 26 formed along the length of the configuration forming members 14 and 16. The anchor surfaces 26 are shown preferably formed between the connecting surfaces 18 and configuration forming surfaces 22 and connecting surfaces 20 and configuration forming surfaces 24. Other anchoring surfaces may be formed to achieve the purposes herein.

Anchor members 28 are provided and are made of a material having suitable strength and rigidity to carry out their purpose in the invention, such as plastic or metal. Each anchor member 28 has a base 30 with a plurality of open surfaces 32. The base 30 is connected to the recessed surface 15 of the support surface 12 by way of screws 34 or the like. The number of open surfaces 32 and screws 34 could be less or more than is shown in each of the anchor members 28. The thickness, length and width of the base 30 are preferably slightly less than the depth, length and width, respectively, of the recessed surface 15 to minimize unwanted indentation in the work piece during formation thereof.

Figures 2, 2A:
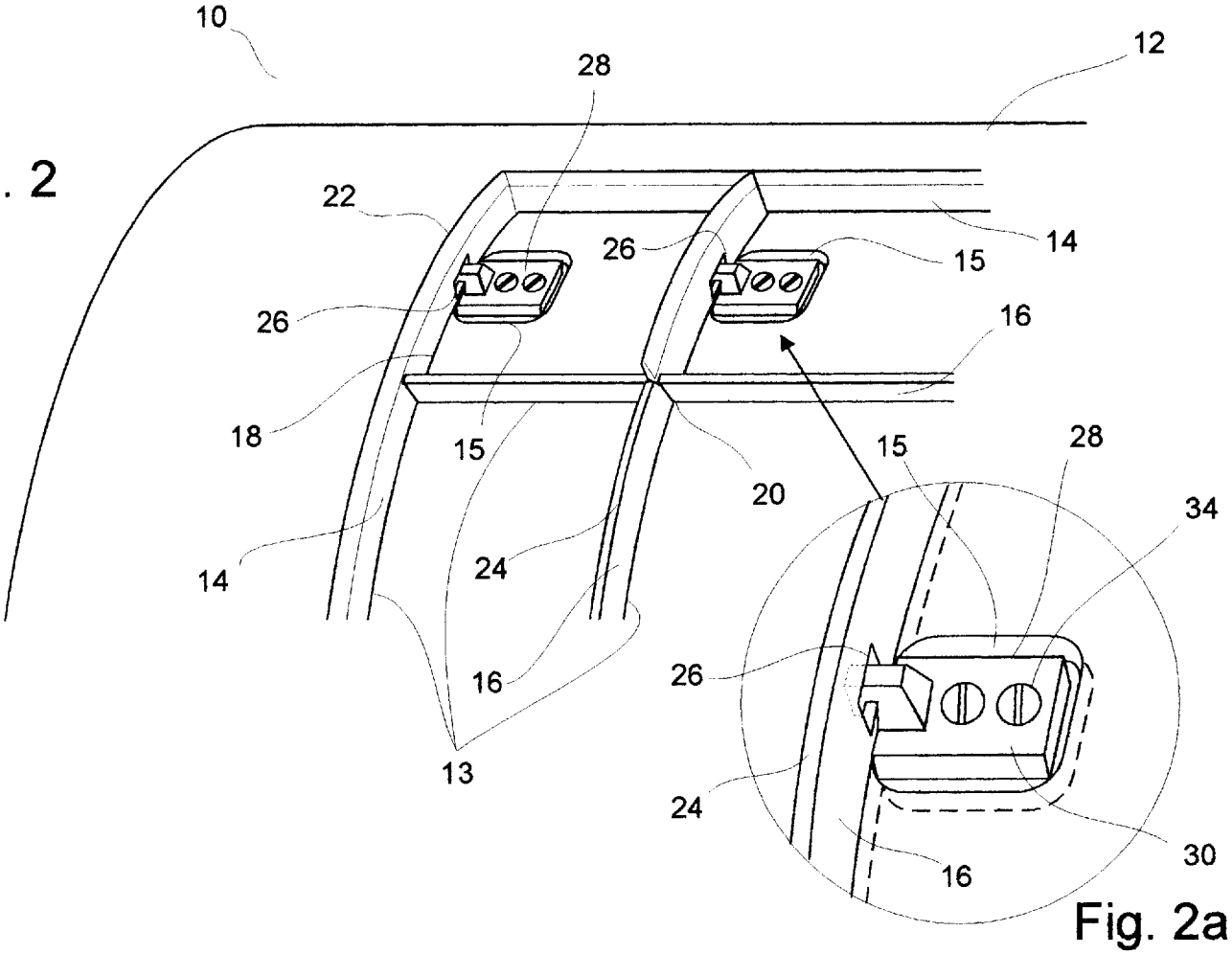
FIG. 2 is a partial enlarged view of FIG. 1 showing an anchor and steel rule in the rule die of the present invention.
FIG. 2*a* is a partial enlarged view of FIG. 2 showing an anchor and steel rule.

A generally J-shaped anchor lip 36 integrally extends from an end of the base 30. When the base 30 is connected to the support surface 12 as shown in FIGS. 1 and 2, the anchor lip 36 extends over and about and contacts the anchor surface 26 in a manner to anchor the configuration forming members 14 and 16 to the support surface 12. In this way, the configuration forming members 14 and 16 are aided to achieve better retention within the channel surfaces 13.

The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed is:

1. A rule die and anchor therefor for use in forming a work piece, which includes:

an arcuate support surface having an arcuate channel surface formed therein;

a configuration forming member having a connecting surface connected to said arcuate channel surface in a manner to impart an arcuate aspect to said configuration forming member and having a configuration forming surface outwardly extending therefrom in a predetermined configuration such that when contacted with the work piece in a predetermined manner imparts a desired configuration on said work piece and wherein said configuration forming member includes an open anchor surface extending therethrough from a first side to a second side of said configuration forming member; and an anchor member having a base connected to said support surface and a generally J-shaped anchor lip extending from said base through said first side and contacting said open anchor surface and said second side in a manner to anchor said configuration forming member to said support surface.

2. The rule die and anchor of claim 1, wherein said anchor surface is formed between said connecting surface and said configuration forming surface.

3. The rule die and anchor of claim 1, wherein said support surface includes a recessed surface wherein said anchor member base is disposed below a remainder of said support.

4. The rule die and anchor of claim 1, wherein said support surface has at least one channel surface formed therein of said predetermined configuration which has said connecting surface of said configuration forming member press-fit therein.

5. The rule die and anchor of claim 1, wherein said configuration forming member is made of steel.

6. A rule die and anchor therefor for use in forming a work piece, which includes:

a generally cylindrical support surface having at least one channel surface formed therein of a predetermined configuration and which extends arcuately along said support surface to form an arcuate channel surface;

a configuration forming member having a connecting surface connectedly press-fit to said channel surface in a manner to impart an arcuate aspect to said configuration forming member and having a configuration forming surface outwardly extending therefrom in a predetermined configuration such that when contacted with the work piece in a predetermined manner imparts a desired configuration on the work piece and wherein said configuration forming member includes an open anchor surface extending therethrough from a first side to a second side of said configuration for forming member; and an anchor member having a base connected to said support surface and a generally, J-shaped anchor lip extending from said base through said first side and contacting said open anchor surface and said second side in a manner to anchor said configuration forming member to said support surface.

7. The rule die and anchor of claim 6, wherein said support surface includes a recessed surface wherein said anchor member base is disposed below a remainder of said support.

8. The rule die and anchor of claim 6, wherein said anchor surface is formed between said connecting surface and said configuration forming surface.

9. A steel rule die and anchor therefor for use in forming a work piece, which includes:

a generally cylindrical support surface having at least one channel surface formed therein and which extends arcuately along said support surface to form an arcuate channel surface of a predetermined configuration and a recessed surface;

a configuration forming steel member having a connecting surface connectedly press-fit to said arcuate channel surface in a manner to impart an arcuate aspect to said configuration forming member and having a configuration forming surface outwardly extending therefrom in a predetermined configuration such that when contacted with the work piece in a predetermined manner imparts a desired configuration on the work piece and wherein said configuration forming member includes an open anchor surface extending therethrough from a first side to a second side of said configuration forming member; and an anchor member having a base connected in said recessed surface and a generally J-shaped anchor lip extending from said base through said first side and contacting said open anchor surface and said second side in a manner to anchor said configuration forming member to said support surface.

* * * * *